US010913916B2

(12) United States Patent
De Rooy et al.

(10) Patent No.: US 10,913,916 B2
(45) Date of Patent: Feb. 9, 2021

(54) LUBRICATING COMPOSITION

(71) Applicant: SHELL OIL COMPANY, Houston, TX (US)

(72) Inventors: Sergio Leon De Rooy, Houston, TX (US); Mark Clift Southby, London (GB)

(73) Assignee: Shell Oil Company, Houston, TX (US)

( * ) Notice: Subject to any disclaimer, the term of this patent is extended or adjusted under 35 U.S.C. 154(b) by 54 days.

(21) Appl. No.: 15/523,728

(22) PCT Filed: Oct. 30, 2015

(86) PCT No.: PCT/EP2015/075280

§ 371 (c)(1),
(2) Date: May 2, 2017

(87) PCT Pub. No.: WO2016/071231

PCT Pub. Date: May 12, 2016

(65) Prior Publication Data

US 2017/0335225 A1 Nov. 23, 2017

Related U.S. Application Data

(60) Provisional application No. 62/074,706, filed on Nov. 4, 2014.

(51) Int. Cl.

| | |
|---|---|
| ***C07F 9/6571*** | (2006.01) |
| ***C10M 137/12*** | (2006.01) |
| *C10N 20/00* | (2006.01) |
| *C10N 30/06* | (2006.01) |
| *C10N 30/10* | (2006.01) |
| *C10N 30/00* | (2006.01) |
| *C10N 40/25* | (2006.01) |

(52) U.S. Cl.

CPC .... *C10M 137/12* (2013.01); *C10M 2205/173* (2013.01); *C10M 2207/026* (2013.01); *C10M 2207/262* (2013.01); *C10M 2215/064* (2013.01); *C10M 2223/045* (2013.01); *C10M 2223/06* (2013.01); *C10N 2020/065* (2020.05); *C10N 2020/069* (2020.05); *C10N 2030/06* (2013.01); *C10N 2030/10* (2013.01); *C10N 2030/42* (2020.05); *C10N 2030/54* (2020.05); *C10N 2040/25* (2013.01); *C10N 2040/252* (2020.05); *C10N 2040/253* (2020.05); *C10N 2040/255* (2020.05)

(58) Field of Classification Search

CPC ..... C10M 137/04; C10M 137/105; C10M 137/12; C10M 2205/173; C10M 2207/026; C10M 2207/262; C10M 2215/064; C10M 2223/045; C10M 2223/06; C10M 141/10; C10M 171/00; C10N 2020/065; C10N 2020/069; C10N 2030/06; C10N 2030/10; C10N 2030/42; C10N 2030/54; C10N 2040/25; C10N 2040/252; C10N 2040/253; C10N 2040/255

USPC ..... 508/422

See application file for complete search history.

(56) References Cited

U.S. PATENT DOCUMENTS

| | | | | |
|---|---|---|---|---|
| 3,048,545 | A * | 8/1962 | Critchley | C10M 3/00 252/78.3 |
| 4,100,089 | A | 7/1978 | Cammack, II et al. | |
| 4,228,020 | A | 10/1980 | Papay | |
| 8,211,840 | B2 | 7/2012 | Devlin et al. | |
| 2005/0143266 | A1* | 6/2005 | Yagishita | C10M 137/00 508/294 |
| 2005/0145052 | A1 | 7/2005 | Matsuda et al. | |
| 2008/0194443 | A1 | 8/2008 | Stoehr et al. | |
| 2010/0190671 | A1 | 7/2010 | Stoehr et al. | |
| 2011/0319305 | A1* | 12/2011 | Eisenberg | C10M 145/14 508/463 |
| 2012/0053100 | A1* | 3/2012 | Radano | C10M 161/00 508/474 |

FOREIGN PATENT DOCUMENTS

| | | | |
|---|---|---|---|
| EP | 0510633 | A1 | 10/1992 |
| EP | 0568348 | A1 | 11/1993 |
| EP | 0668342 | A1 | 8/1995 |
| EP | 0776959 | A2 | 6/1997 |
| EP | 1029029 | A1 | 8/2000 |
| JP | S49123903 | A | 11/1974 |

(Continued)

OTHER PUBLICATIONS

Henderson, "Fischer-Tropsch gas to liquids base stocks—Performance beyond current synthesis", International Journal of Hydrocarbon Engineering, vol. 7, Aug. 1, 2002, pp. 13-14,16,18, XP009128262.

International Search Report and Written Opinion received for PCT Patent Application No. PCT/EP2015/075280, dated Jan. 21, 2016, 11 pages.

Kirk-Othmer Encyclopedia of Chemical Technology, Third Edition, vol. 14, 1979, pp. 477-526.

(Continued)

*Primary Examiner* — Prem C Singh
*Assistant Examiner* — Francis C Campanell

(57) ABSTRACT

Lubricating composition comprising (i) base oil and (ii) a metal-free phosphonate compound having the general formula $P(=O)(R^1)(OR^2)(OR^3)$ wherein $R^1$, $R^2$ and $R^3$ are the same or different and each independently selected from a straight chain or branched, saturated or unsaturated, $C_4$-$C_{22}$ alkyl group. The lubricating composition of the present invention provides improved engine durability, improved wear and friction reduction, improved fuel economy and excellent oxidative stability.

9 Claims, No Drawings

(56) References Cited

FOREIGN PATENT DOCUMENTS

| | | | |
|---|---|---|---|
| JP | 1302811 | B | 2/1986 |
| JP | 1367796 | B | 3/1987 |
| JP | 1667140 | B | 5/1992 |
| JP | 1743435 | B | 3/1993 |
| JP | 005002215 | A | 1/2005 |
| JP | 2007505191 | A | 3/2007 |
| JP | 2009126896 | A | 6/2009 |
| RU | 2064971 | C1 | 8/1996 |
| RU | 2141508 | C1 | 11/1999 |
| WO | 9721788 | A1 | 6/1997 |
| WO | 9826030 | A1 | 6/1998 |
| WO | 9941332 | A1 | 8/1999 |
| WO | 0008115 | A1 | 2/2000 |
| WO | 0014179 | A1 | 3/2000 |
| WO | 0014183 | A1 | 3/2000 |
| WO | 0014187 | A2 | 3/2000 |
| WO | 0014188 | A2 | 3/2000 |
| WO | 0015736 | A2 | 3/2000 |
| WO | 00118156 | A1 | 3/2001 |
| WO | 0157166 | A1 | 8/2001 |
| WO | 02070631 | A2 | 9/2002 |
| WO | 2013189951 | A1 | 12/2013 |

OTHER PUBLICATIONS

American Petroleum Institute (API) Publication 1509, 15th Edition, Appendix E, Apr. 2002.

* cited by examiner

LUBRICATING COMPOSITION

PRIORITY CLAIM

The present application is the National Stage (§ 371) of International Application No. PCT/EP2015/075280, filed Oct. 30, 2015, which claims priority from U.S. Patent Application No. 62/074,706, filed Nov. 4, 2014 incorporated herein by reference.

FIELD OF THE INVENTION

The present invention relates to a lubricating composition, in particular to a lubricating composition which is suitable for lubricating internal combustion engines and which has improved engine durability and improved friction and wear reduction, as well as excellent oxidation stability and improved fuel economy.

BACKGROUND OF THE INVENTION

Engine durability is an important consideration in the choice of a lubricant, especially for heavy duty diesel engine applications. Original Equipment Manufacturers (OEMs) are continuing to increase their oil drain intervals and the average lifetime of vehicles has steadily increased over the last few decades. There is a trend towards replacing, at least partially, metal-containing phosphorus-containing compounds such as zinc dialkyl dithiophosphates (commonly referred to as ZDDP) with alternative ashless antiwear agents which have a lower impact on after treatment systems such as diesel particulate filters in heavy duty diesel vehicles. As well as being an anti-wear agent, ZDDP has anti-oxidant properties. Therefore, it would be desirable to wholly or partially replace metal-containing phosphorus-containing compounds such as zinc dialkyl dithiophosphate (ZDDP) with ashless phosphorus-based anti-wear agent(s) which also have anti-oxidant properties.

Diamyl amyl phosphonate or pentyl phosphonic acid dipentyl ester (DAAP) has traditionally been used as an extractant for rare earths. However, it is not known for use in lubricant compositions.

It has now surprisingly been found by the present inventors that diamyl amyl phosphonate and other related metal-free phosphonate compounds can be used to partially or fully replace metal-containing phosphate compounds such as zinc dialkyl dithiophosphates (ZDDP) in a lubricant composition while providing wear and friction reduction, as well as anti-oxidant benefits.

It has also been surprisingly found that the lubricating composition of the present invention reduces friction, thus helping to provide improved fuel economy properties.

SUMMARY OF THE INVENTION

Accordingly, the present invention provides a lubricating composition comprising (i) base oil and (ii) a metal-free phosphonate compound having the general formula $P(=O)(R^1)(OR^2)(OR^3)$ wherein $R^1$, $R^2$ and $R^3$ are the same or different and each independently selected from a straight chain or branched, saturated or unsaturated, $C_4$-$C_{22}$ alkyl group.

According to a second aspect of the present invention, there is provided the use of a lubricating composition comprising (i) base oil and (ii) a metal-free phosphonate compound having the general formula $P(=O)(R^1)(OR^2)(OR^3)$ wherein $R^1$, $R^2$ and $R^3$ are the same or different and each independently selected from a straight chain or branched, saturated or unsaturated, $C_4$-$C_{22}$ alkyl group for providing reduced wear.

According to yet a further aspect of the present invention, there is provided the use of a lubricating composition comprising (i) base oil and (ii) a metal-free phosphonate compound having the general formula $P(=O)(R^1)(OR^2)(OR^3)$ wherein $R^1$, $R^2$ and $R^3$ are the same or different and each independently selected from a straight chain or branched, saturated or unsaturated, $C_4$-$C_{22}$ alkyl group for providing reduced friction.

According to yet a further aspect of the present invention, there is provided the use of a lubricating composition comprising (i) base oil and (ii) a metal-free phosphonate compound having the general formula $P(=O)(R^1)(OR^2)(OR^3)$ wherein $R^1$, $R^2$ and $R^3$ are the same or different and each independently selected from a straight chain or branched, saturated or unsaturated, $C_4$-$C_{22}$ alkyl group for providing reduced friction and wear.

According to yet a further aspect of the present invention, there is provided the use of a lubricating composition comprising (i) base oil and (ii) a metal-free phosphonate compound having the general formula $P(=O)(R^1)(OR^2)(OR^3)$ wherein $R^1$, $R^2$ and $R^3$ are the same or different and each independently selected from a straight chain or branched, saturated or unsaturated, $C_4$-$C_{22}$ alkyl group for providing improved fuel economy.

DETAILED DESCRIPTION OF THE INVENTION

An essential component of the lubricating compositions of the present invention is a metal-free phosphonate compound, in particular a metal-free phosphonate compound having the general formula $P(=O)(R^1)(OR^2)(OR^3)$ wherein $R^1$, $R^2$ and $R^3$ are the same or different and each independently selected from a straight chain or branched, saturated or unsaturated, $C_4$-$C_{22}$ alkyl group.

Preferably, $R^1$, $R^2$ and $R^3$ are the same or different and each independently selected from a straight chain or branched, saturated or unsaturated, $C_4$-$C_{12}$ alkyl group. More preferably, $R^1$, $R^2$ and $R^3$ are the same or different and each independently selected from a straight chain or branched, saturated or unsaturated, $C_4$-$C_8$ alkyl group. Even more preferably, $R^1$, $R^2$ and $R^3$ are the same or different and each independently selected from a straight chain or branched, saturated or unsaturated, $C_4$-$C_6$ alkyl group.

Preferably $R^1$, $R^2$ and $R^3$ are straight chain alkyl groups. More preferably, $R^1$, $R^2$ and $R^3$ are straight chain, saturated, alkyl groups.

In one embodiment of the present invention, $R^2$ and $R^3$ are the same and $R^1$ is different. In another embodiment of the present invention, $R^1$, $R^2$ and $R^3$ are the same.

In a preferred embodiment of the present invention, $R^1$, $R^2$ and $R^3$ are all butyl groups (i.e. DBBP (dibutyl butyl phosphonate)). This compound is commercially available from Sigma-Aldrich.

In a particularly preferred embodiment of the present invention $R^1$, $R^2$ and $R^3$ are all pentyl groups (i.e. Diamyl amyl phosphonate or pentyl phosphonic acid dipentyl ester (DAAP)). This compound is commercially available from Sigma-Aldrich.

The lubricating composition herein may generally comprise in the range of from 0.4 to 1.2 wt. %, preferably in the range of from 0.5 to 1 wt %, of the metal-free phosphonate compound, based on total weight of the lubricating oil composition.

The metal-free phosphonate compound can be included in the lubricating composition of the present invention as an individual component or as part of an additive package together with other additive components.

In addition to the metal-free phosphonate compound, the lubricating compositions of the present invention may comprise one or more metal-containing phosphorus anti-wear agents. Suitable metal-containing phosphorus anti-wear additives that may be conveniently used herein include zinc-containing compounds such as zinc dithiophosphate compounds selected from zinc dialkyl-, diaryl- and/or alkylaryl-dithiophosphates.

In one embodiment of the present invention, the lubricating composition may comprise a single zinc dithiophosphate or a combination of two or more zinc dithiophosphates as anti-wear additives, the or each zinc dithiophosphate being selected from zinc dialkyl-, diaryl- or alkylaryl-dithiophosphates.

Zinc dithiophosphate is a well known additive in the art and may be conveniently represented by general formula II;

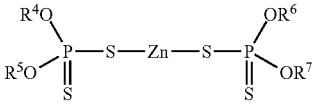

(II)

wherein $R^4$ to $R^7$ may be the same or different and are each a primary alkyl group containing from 1 to 20 carbon atoms preferably from 3 to 12 carbon atoms, a secondary alkyl group containing from 3 to 20 carbon atoms, preferably from 3 to 12 carbon atoms, an aryl group or an aryl group substituted with an alkyl group, said alkyl substituent containing from 1 to 20 carbon atoms preferably 3 to 18 carbon atoms.

Zinc dithiophosphate compounds in which $R^4$ to $R^7$ are all different from each other can be used alone or in admixture with zinc dithiophosphate compounds in which $R^4$ to $R^7$ are all the same.

Preferably, the or each zinc dithiophosphate used in the present invention is a zinc dialkyl dithiophosphate.

Examples of suitable zinc dithiophosphates which are commercially available include those available ex. Lubrizol Corporation under the trade designations "Lz 1097" and "Lz 1395", those available ex. Chevron Oronite under the trade designations "OLOA 267" and "OLOA 269R", and that available ex. Afton Chemical under the trade designation "HITEC 7197"; zinc dithiophosphates such as those available ex. Lubrizol Corporation under the trade designations "Lz 677A", "Lz 1095" and "Lz 1371", that available ex. Chevron Oronite under the trade designation "OLOA 262" and that available ex. Afton Chemical under the trade designation "HITEC 7169"; and zinc dithiophosphates such as those available ex. Lubrizol Corporation under the trade designations "Lz 1370" and "Lz 1373" and that available ex. Chevron Oronite under the trade designation "OLOA 260".

The lubricating composition herein may generally comprise in the range of from 0 to 1.2 wt %, preferably from 0.4 to 1.2 wt. %, more preferably from 0.5 to 1 wt % of zinc dithiophosphate, based on total weight of the lubricating oil composition.

The lubricating compositions of the present invention preferably comprise 0.08 wt % or less of phosphorus, by weight of the lubricating composition. Hence the metal-free phosphonate compound and the metal-containing phosphorus anti-wear agents are preferably present at a level so as to provide 0.08 wt % or less of phosphorus, by weight of the lubricating composition.

In one embodiment of the present invention, the lubricating composition comprises from 0.06 wt % to 0.08 wt % of phosphorus, by weight of the lubricating composition (a "mid-SAPS" lubricant formulation). Hence, in such an embodiment, the metal-free phosphonate compound and the metal-containing phosphorus anti-wear agents are preferably present at a level so as to provide from 0.06 wt % to 0.08 wt % of phosphorus, by weight of the lubricating composition.

In another embodiment of the present invention, the lubricating composition comprises 0.05 wt % or less of phosphorus, by weight of the lubricating composition (a "low-SAPS" lubricant formulation). Hence, in such an embodiment, the metal-free phosphonate compound and the metal-containing phosphorus anti-wear agents are preferably present at a level so as to provide 0.05 wt % or less of phosphorus, by weight of the lubricating composition.

It is also an option to take advantage of the benefits of the present invention in a full SAPS formulation. Therefore in one embodiment of the present invention, the lubricating composition comprises 0.12 wt % or less of phosphorus, by weight of the lubricating composition (a "full-SAPS" lubricant formulation). Hence in such an embodiment, the metal-free phosphonate compound and the metal-containing phosphorus anti-wear agents are preferably present at a level so as to provide 0.12 wt % or less of phosphorus, by weight of the lubricating composition.

One advantage of the present invention is that it allows the partial or complete replacement of metal-containing anti-wear additives, such as zinc dialkyl dithiophosphonate. According to one aspect of the present invention, the lubricating composition is free of metal-containing anti-wear additives such as zinc dithiophosphates.

There are no particular limitations regarding the base oil used in lubricating composition according to the present invention, and various conventional mineral oils, and synthetic oils as well as naturally derived esters such as vegetable oils may be conveniently used.

The base oil used in the present invention may conveniently comprise mixtures of one or more mineral oils and/or one or more synthetic oils; thus, according to the present invention, the term "base oil" may refer to a mixture containing more than one base oil. Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Suitable base oils for use in the lubricating oil composition of the present invention are Group I-III mineral base oils (preferably Group III), Group IV poly-alpha olefins (PAOs), Group II-III Fischer-Tropsch derived base oils (preferably Group III), Group V ester base oils, and mixtures thereof.

By "Group I", "Group II" "Group III" and "Group IV" and "Group V" base oils in the present invention are meant lubricating oil base oils according to the definitions of American Petroleum Institute (API) for categories I, II, III, IV and V. These API categories are defined in API Publication 1509, 15th Edition, Appendix E, April 2002.

A preferred base oil for use herein in a Fischer-Tropsch derived base oil. Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To- Liquids) base oil. Suitable Fischer-Tropsch derived base oils that may be conveniently used as the base oil in the lubricating composition of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

Typically, the aromatics content of a Fischer-Tropsch derived base oil, suitably determined by ASTM D 4629, will typically be below 1 wt. %, preferably below 0.5 wt. % and more preferably below 0.1 wt. %. Suitably, the base oil has a total paraffin content of at least 80 wt. %, preferably at least 85, more preferably at least 90, yet more preferably at least 95 and most preferably at least 99 wt. %. It suitably has a saturates content (as measured by IP-368) of greater than 98 wt. %. Preferably the saturates content of the base oil is greater than 99 wt. %, more preferably greater than 99.5 wt. %. It further preferably has a maximum n-paraffin content of 0.5 wt. %. The base oil preferably also has a content of naphthenic compounds of from 0 to less than 20 wt. %, more preferably of from 0.5 to 10 wt. %.

The base oil for use herein can comprise a Fischer-Tropsch base oil or a blend of Fischer-Tropsch base oils.

Typically, the Fischer-Tropsch derived base oil or base oil blend has a kinematic viscosity at 100° C. (as measured by ASTM D 7042) in the range of from 1 to 30 $mm^2/s$ (cSt), preferably from 1 to 25 $mm^2/s$ (cSt), and more preferably from 2 $mm^2/s$ to 12 $mm^2/s$. Preferably, the Fischer-Tropsch derived base oil has a kinematic viscosity at 100° C. (as measured by ASTM D 7042) of at least 2.5 $mm^2/s$, more preferably at least 3.0 $mm^2/s$. In one embodiment of the present invention, the Fischer-Tropsch derived base oil has a kinematic viscosity at 100° C. of at most 5.0 $mm^2/s$, preferably at most 4.5 $mm^2/s$, more preferably at most 4.2 $mm^2/s$ (e.g. "GTL 4"). In another embodiment of the present invention, the Fischer-Tropsch derived base oil has a kinematic viscosity at 100° C. of at most 8.5 $mm^2/s$, preferably at most 8 $mm^2/s$ (e.g. "GTL 8").

Further, the Fischer-Tropsch derived base oil typically has a kinematic viscosity at 40° C. (as measured by ASTM D 7042) of from 10 to 100 $mm^2/s$ (cSt), preferably from 15 to 50 $mm^2/s$.

Also, the Fischer-Tropsch derived base oil preferably has a pour point (as measured according to ASTM D 5950) of below −30° C., more preferably below −40° C., and most preferably below −45° C.

The flash point (as measured by ASTM D92) of the Fischer-Tropsch derived base oil is preferably greater than 120° C., more preferably even greater than 140° C.

The Fischer-Tropsch derived base oil preferably has a viscosity index (according to ASTM D 2270) in the range of from 100 to 200. Preferably, the Fischer-Tropsch derived base oil has a viscosity index of at least 125, preferably 130. Also it is preferred that the viscosity index is below 180, preferably below 150.

In the event the Fischer-Tropsch derived base oil contains a blend of two or more Fischer-Tropsch derived base oils, the above values apply to the blend of the two or more Fischer-Tropsch derived base oils.

Synthetic oils include hydrocarbon oils such as olefin oligomers (including polyalphaolefin base oils; PAOs), dibasic acid esters, polyol esters, polyalkylene glycols (PAGs), alkyl naphthalenes and dewaxed waxy isomerates. Synthetic hydrocarbon base oils sold by the Shell Group under the designation "Shell XHVI" (trade mark) may be conveniently used.

Poly-alpha olefin base oils (PAOs) and their manufacture are well known in the art. Preferred poly-alpha olefin base oils that may be used in the lubricating compositions of the present invention may be derived from linear $C_2$ to $C_{32}$, preferably $C_6$ to $C_{16}$, alpha olefins. Particularly preferred feedstocks for said poly-alpha olefins are 1-octene, 1-decene, 1-dodecene and 1-tetradecene.

There is a strong preference for using a Fischer-Tropsch derived base oil over a PAO base oil, in view of the high cost of manufacture of the PAOs. Thus, preferably, the base oil contains more than 50 wt. %, preferably more than 60 wt. %, more preferably more than 70 wt. %, even more preferably more than 80 wt. %. most preferably more than 90 wt. % Fischer-Tropsch derived base oil. In an especially preferred embodiment not more than 5 wt. %, preferably not more than 2 wt. %, of the base oil is not a Fischer-Tropsch derived base oil. It is even more preferred that 100 wt % of the base oil is based on one or more Fischer-Tropsch derived base oils.

The total amount of base oil incorporated in the lubricating composition of the present invention is preferably in the range of from 60 to 99 wt. %, more preferably in the range of from 65 to 90 wt. % and most preferably in the range of from 70 to 85 wt. %, with respect to the total weight of the lubricating composition.

Typically the base oil (or base oil blend) as used according to the present invention has a kinematic viscosity at 100° C. (according to ASTM D445) of above 2.5 cSt and below 9.3 cSt. According to a preferred embodiment of the present invention the base oil has a kinematic viscosity at 100° C. (according to ASTM D445) of from 3.8 to 9.3 cst. In the event the base oil contains a blend of two or more base oils, it is preferred that the blend has a kinematic viscosity at 100° C. of between 2.5 and 9.3 cSt.

Typically the lubricating compositions of the present invention would be utilised in, but not necessarily limited to, SAE J300 viscosity grades 0W-20, 0W-30, 0W-40, 5W-20, 5W-30 and 5W-40, 10W-30 and 10W-40 as these are the grades which target fuel economy. As new SAE J300 viscosity grades are published, with lower viscosities than the current 0W-20, the present invention would also be very much applicable to these new viscosity lower grades. The present invention is also suitable for use with higher viscosity grades.

The lubricating composition according to the present invention preferably has a Noack volatility (according to ASTM D 5800) of below 15 wt. %. Typically, the Noack volatility (according to ASTM D 5800) of the composition is between 1 and 15 wt. %, preferably below 14.6 wt. % and more preferably below 14.0 wt. %.

Preferably, the lubricating oil composition has a kinematic viscosity in the range of from 1.5 to 30 $mm^2/s$ at 100° C., more preferably of from 3 to 20 $mm^2/s$, most preferably of from 5 to 17 $mm^2/s$.

The total amount of phosphorus in the lubricating oil composition herein is preferably less than or equal to 0.08 wt %, by weight of the lubricating composition.

The lubricating oil composition herein preferably has a sulphated ash content of not greater than 2.0 wt. %, more preferably not greater than 1.0 wt. % and most preferably not greater than 0.8 wt. %, based on the total weight of the lubricating oil composition.

The lubricating oil composition herein preferably has a sulphur content of not greater than 1.2 wt. %, more preferably not greater than 0.8 wt. % and most preferably not greater than 0.2 wt. %, based on the total weight of the lubricating oil composition.

The lubricating composition according to the present invention further comprises one or more additives such as anti-oxidants, anti-wear additives, dispersants, detergents, overbased detergents, extreme pressure additives, friction modifiers, viscosity index improvers, pour point depressants, metal passivators, corrosion inhibitors, demulsifiers, anti-foam agents, seal compatibility agents and additive diluent base oils, etc.

As the person skilled in the art is familiar with the above and other additives, these are not further discussed here in detail. Specific examples of such additives are described in for example Kirk-Othmer Encyclopedia of Chemical Technology, third edition, volume 14, pages 477-526.

Antioxidants that may be conveniently used include those selected from the group of aminic antioxidants and/or phenolic antioxidants.

In a preferred embodiment, said antioxidants are present in an amount in the range of from 0.1 to 5.0 wt. %, more preferably in an amount in the range of from 0.3 to 3.0 wt. %, and most preferably in an amount in the range of from 0.5 to 1.5 wt. %, based on the total weight of the lubricating oil composition.

Examples of aminic antioxidants which may be conveniently used include alkylated diphenylamines, phenyl-α-naphthylamines, phenyl-β-naphthylamines and alkylated α-naphthylamines.

Preferred aminic antioxidants include dialkyldiphenylamines such as p,p'-dioctyl-diphenylamine, p,p'-di-α-methylbenzyl-diphenylamine and N-p-butylphenyl-N-p'-octylphenylamine, monoalkyldiphenylamines such as mono-t-butyldiphenylamine and mono-octyldiphenylamine, bis (dialkylphenyl)amines such as di-(2,4-diethylphenyl)amine and di(2-ethyl-4-nonylphenyl)amine, alkylphenyl-1-naphthylamines such as octylphenyl-1-naphthylamine and n-t-dodecylphenyl-1-naphthylamine, 1-naphthylamine, arylnaphthylamines such as phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine and 3,7-dioctylphenothiazine.

Preferred aminic antioxidants include those available under the following trade designations: "Sonoflex OD-3" (ex. Seiko Kagaku Co.), "Irganox L-57" (ex. Ciba Specialty Chemicals Co.) and phenothiazine (ex. Hodogaya Kagaku Co.).

Examples of phenolic antioxidants which may be conveniently used include $C_7$-$C_9$ branched alkyl esters of 3,5-bis (1,1-dimethyl-ethyl)-4-hydroxy-benzenepropanoic acid, 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone, 2,6-di-t-butyl-4-alkylphenols such as 2,6-di-t-butylphenol, 2,6-di-t-butyl-4-methylphenol and 2,6-di-t-butyl-4-ethylphenol, 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptooctylacetate, alkyl-3-(3,5-di-t-butyl-4-hydroxyphenyl)propionates such as n-octadecyl-3-(3,5-di-t-butyl-4-hydroxyphenyl)propionate, n-butyl-3-(3,5-di-t-butyl-4-hydroxyphenyl)propionate and 2'-ethylhexyl-3-(3,5-di-t-butyl-4-hydroxyphenyl)propionate, 2,6-d-t-butyl-α-dimethylamino-p-cresol, 2,2'-methylene-bis(4-alkyl-6-t-butylphenol) such as 2,2'-methylenebis (4-methyl-6-t-butylphenol, and 2,2-methylenebis(4-ethyl-6-t-butylphenol), bisphenols such as 4,4'-butylidenebis(3-methyl-6-t-butylphenol, 4,4'-methylenebis(2,6-di-t-butylphenol), 4,4'-bis(2,6-di-t-butylphenol), 2,2-(di-p-hydroxyphenyl)propane, 2,2-bis(3,5-di-t-butyl-4-hydroxyphenyl)propane, 4,4'-cyclohexylidenebis(2,6-t-butylphenol), hexamethyleneglycol-bis[3-(3,5-di-t-butyl-4-hydroxyphenyl) propionate], triethyleneglycolbis[3-(3-t-butyl-4-hydroxy-5-methylphenyl)propionate], 2,2'-thio-[diethyl-3-(3,5-di-t-butyl-4-hydroxyphenyl)propionate], 3,9-bis{1,1-dimethyl-2-[3-(3-t-butyl-4-hydroxy-5-methylphenyl)propionyloxy]ethyl}2,4,8,10-tetraoxaspiro[5,5]undecane, 4,4'-thiobis(3-methyl-6-t-butylphenol) and 2,2'-thiobis(4,6-di-t-butylresorcinol), polyphenols such as tetrakis[methylene-3-(3,5-di-t-butyl-4-hydroxyphenyl)propionate]methane, 1,1,3-tris(2-methyl-4-hydroxy-5-t-butylphenyl)butane, 1,3,5-trimethyl-2,4,6-tris(3,5-di-t-butyl-4-hydroxybenzyl)benzene, bis-[3,3'-bis(4'-hydroxy-3'-t-butylphenyl)butyric acid]glycol ester, 2-(3',5'-di-t-butyl-4-hydroxyphenyl)methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol, and p-t-butylphenol-formaldehyde condensates and p-t-butylphenol-acetaldehyde condensates.

Preferred phenolic antioxidants include those available under the following trade designations: "Irganox L-135" (ex. Ciba Specialty Chemicals Co.), "Yoshinox SS" (ex. Yoshitomi Seiyaku Co.), "Antage W-400" (ex. Kawaguchi Kagaku Co.), "Antage W-500" (ex. Kawaguchi Kagaku Co.), "Antage W-300" (ex. Kawaguchi Kagaku Co.), "Irganox L109" (ex. Ciba Speciality Chemicals Co.), "Tominox 917" (ex. Yoshitomi Seiyaku Co.), "Irganox L115" (ex. Ciba Speciality Chemicals Co.), "Sumilizer GA80" (ex. Sumitomo Kagaku), "Antage RC" (ex. Kawaguchi Kagaku Co.), "Irganox L101" (ex. Ciba Speciality Chemicals Co.), "Yoshinox 930" (ex. Yoshitomi Seiyaku Co.).

The lubricating oil composition of the present invention may comprise mixtures of one or more phenolic antioxidants with one or more aminic antioxidants.

Other anti-wear additives that may be conveniently used as well as those already mentioned above include molybdenum-containing compounds, boron-containing compounds and ashless anti-wear additives such as substituted or unsubstituted thiophosphoric acids, and salts thereof.

Examples of such molybdenum-containing compounds may conveniently include molybdenum dithiocarbamates, trinuclear molybdenum compounds, for example as described in WO 98/26030, sulphides of molybdenum and molybdenum dithiophosphate.

Boron-containing compounds that may be conveniently used include borate esters, borated fatty amines, borated epoxides, alkali metal (or mixed alkali metal or alkaline earth metal) borates and borated overbased metal salts.

Typical detergents that may be used in the lubricating composition herein include one or more salicylate and/or phenate and/or sulphonate detergents.

However, as metal organic and inorganic base salts which are used as detergents can contribute to the sulphated ash content of a lubricating oil composition, in a preferred embodiment of the present invention, the amounts of such additives are minimised.

Furthermore, in order to maintain a low sulphur level, salicylate detergents are preferred.

Thus, in a preferred embodiment, the lubricating oil composition herein may comprise one or more salicylate detergents.

In order to maintain the total sulphated ash content of the lubricating oil composition herein at a level of preferably not greater than 2.0 wt. %, more preferably at a level of not greater than 1.0 wt. % and most preferably at a level of not greater than 0.8 wt. %, based on the total weight of the lubricating oil composition, said detergents are preferably used in amounts in the range of 0.05 to 20.0 wt. %, more preferably from 1.0 to 10.0 wt. % and most preferably in the range of from 2.0 to 5.0 wt. %, based on the total weight of the lubricating oil composition.

Furthermore, it is preferred that said detergents, independently, have a TBN (total base number) value in the range of from 10 to 500 mg·KOH/g, more preferably in the range of from 30 to 350 mg·KOH/g and most preferably in the range of from 50 to 300 mg·KOH/g, as measured by ISO 3771.

The lubricating oil compositions herein may additionally contain an ash-free dispersant which is preferably admixed in an amount in the range of from 5 to 15 wt. %, based on the total weight of the lubricating oil composition.

Examples of ash-free dispersants which may be used include the polyalkenyl succinimides and polyalkenyl succininic acid esters disclosed in Japanese Patent Nos. 1367796, 1667140, 1302811 and 1743435. Preferred dispersants include borated succinimides.

Examples of viscosity index improvers which may conveniently be used in the lubricating composition herein include the styrene-butadiene stellate copolymers, styrene-isoprene stellate copolymers and the polymethacrylate copolymer and ethylene-propylene copolymers (also known as olefin copolymers) of the crystalline and non-crystalline type. Comb polymers are also useful herein as viscosity index improvers. Dispersant-viscosity index improvers may be used in the lubricating composition herein. The term "Viscosity Modifier" as used hereafter is meant to be the same as the above-mentioned term "Viscosity Index improver concentrate".

A particularly preferred viscosity index improver for use herein is a comb polymer, preferably in a solid polymer amount of from 0.1 wt % to 10 wt %, more preferably from 0.25 wt % to 7 wt %, and even more preferably from 0.5 wt % to 4 wt %, by weight of the total lubricating composition. Suitable comb polymers for use herein include those disclosed in US2010/0190671.

Preferred comb polymers for use herein comprise, in the main chain, at least one repeat unit which is obtained from at least one polyolefin-based macromonomer, and at least one repeat unit which is obtained from at least one low molecular weight monomer selected from the group consisting of styrene monomers having 8 to 17 carbon atoms, alkyl(meth)acrylates having 1 to 10 carbon atoms in the alcohol group, vinyl esters having from 1 to 11 carbon atoms in the acyl group, vinyl ethers having 1 to 10 carbon atoms in the alcohol group, (di)alkyl fumurates having 1 to 10 carbon atoms in the alcohol group, (di)alkyl maleates having 1 to 10 carbon atoms in the alcohol group and mixtures thereof, where the molar degree of branching is in the range of 0.1 to 10 mol % and the comb polymer comprises a total of at least 80% by weight, based on the total weight of repeat units of the comb polymer, (or in another aspect based on the total weight of the comb polymer), of the at least one repeat unit which is obtained from the at least one polyolefin-based macromonomer and the at least one repeat unit which is obtained from the at least one low molecular weight monomer.

Preferably, comb polymers used herein have 8% to 30% by weight of repeat units which are derived from polyolefin-based macromonomers, and the molar degree of branching of the comb polymer is in the range of 0.3% to 1.1%.

The term "comb polymer" as used herein means that relatively long side chains are bonded to a polymeric main chain, frequently also known as the backbone. The comb polymers used in the present invention have at least one repeat unit which is derived from polyolefin-based macromonomers. The exact proportion is evident via the molar degree of branching. The term "main chain" as used herein does not necessarily mean that the chain length of the main chain is greater than that of the side chains. Instead, this term relates to the composition of this chain. While the side chain has very high proportions of olefinic repeat units, especially units which are derived from alkenes or alkadienes, for example ethylene, propylene, n-butene, isobutene, butadiene, isoprene, the main chain comprises relatively large proportions of polar unsaturated monomers which have been detailed above.

The term "repeat unit" is known to those skilled in the art. The present comb polymers can be obtained by a process which involves the free-radical polymerisation of macromonomers and low molecular weight monomers, wherein double bonds are opened up to form covalent bonds. Accordingly, the repeat unit arises from the monomers used. However, the comb polymers can also be prepared by polymer-analagous reactions and graft copolymerisation. In this case, the converted repeat unit of the main chain is counted as a repeat unit which is derived from a polyolefin-based macromonomer. The same applies in the case of preparation of the comb polymers by graft polymerization.

Further details of preparation methods of comb polymers which can be used herein can be found in US2010/0190671 and US2008/0194443, which are incorporated herein by reference.

The comb polymers preferred for use herein comprise repeat units which are derived from polyolefin-based macromonomers. These repeat units comprise at least one group which is derived from polyolefins. Examples of suitable polyolefins include $C_2$-$C_{10}$ alkenes, such as ethylene, propylene, n-butene, isobutene, norbornene, and/or $C_4$-$C_{10}$ alkadienes such as butadiene, isoprene, norbornadiene, and the like.

The repeat units derived from polyolefin-based macromonomers preferably comprise at least 70% by weight and more preferably at least 80% by weight and most preferably at least 90% by weight of groups which are derived from alkene and/or alkadienes, based on the weight of the repeat units derived from polyolefin-based macromonomers.

The polyolefinic groups may also be present in hydrogenated form. In addition to the groups which are derived from alkenes and/or alkadienes, the repeat units derived from polyolefin-based macromonomers may comprise further groups. These include small proportions of copolymerizable monomers, including among others, alkyl (meth)acrylates, styrene monomers, fumurates, maleates, vinyl esters and/or vinyl ethers. The proportion of these groups based on copolymerizable monomers is preferably at most 30% by weight, more preferably at most 15% by weight, based on the weight of the repeat units derived from polyolefin-based macromonomers. The repeat units derived from polyolefin-based macromonomers may comprise start groups and/or end groups which serve from functionalization or are caused by the preparation of the repeat units derived from polyolefin-based macromonomers. The proportion of these start groups and/or end groups is preferably at most 30% by weight, more preferably at most 15% by weight, based on the weight of the repeat units derived from polyolefin-based macromonomers.

The number-average molecular weight of the repeat units which are derived from polyolefin-based macromonomers is preferably in the range from 500 to 50000 g/mol, more preferably from 700 to 10000 g/mol, even more preferably from 1500 to 4900 g/mol and most preferably from 2000 to 3000 g/mol.

The melting point of the repeat units derived from the polyolefin-based macromonomers is preferably less than or equal to −10° C., more preferably less than or equal to −20° C., even more preferably less than or equal to −40° C., as measured by DSC. Most preferably, no DSC melting point can be measured for the repeat units derived from the polyolefin-based macromonomers.

In addition to the repeat units which are derived from the polyolefin-based macromonomers, the comb polymers useful in the present invention comprise repeat units which are derived from low molecular weight monomers selected from the group consisting of styrene monomers having 8 to 17 carbon atoms, alkyl(meth)acrylates having 1 to 10 carbon atoms in the alcohol group, vinyl esters having 1 to 11 carbon atoms in the acyl group, vinyl ethers having 1 to 10 carbon atoms in the alcohol group, di(alkyl) fumurates having 1 to 10 carbon atoms in the alcohol group, (di)alkyl maleates having 1 to 10 carbon atoms in the alcohol group, and mixtures of these monomers.

The molecular weight of the low molecular weight repeat units or of the low molecular weight monomers is preferably at most 400 g/mol, more preferably at most 200 g/mol and most preferably at most 150 g/mol.

Examples of styrene monomers having 8 to 17 carbon atoms are styrene, substituted styrenes having an alkyl substituent in the side chain, for example, alpha-methylstyrene and alpha-ethyl-styrene, substituted styrenes having an alkyl substituent on the ring, such as vinyltoluene p-methylstyrene, halogenated styrenes, for example monochlorostyrenes, dichlorostyrenes, tribromostyrenes, and tetrabromostyrenes.

The term "(meth)acrylates" encompasses acrylates and methacrylates, and also mixtures of acrylates and methacrylates. The alkyl (meth)acrylates having 1 to 10 carbon atoms in the alcohol group include (meth)acrylates which are derived from saturated alcohols, such as methyl(meth)acrylate, ethyl(meth)acrylate, n-propyl(meth)acrylate, isopropyl (meth)acrylate, n-butyl(meth)acrylate, tert-butyl(meth)acrylate, pentyl(meth)acrylate, hexyl(meth)acrylate, 2-ethylhexyl(meth)acrylate, heptyl(meth)acrylate, 2-tert-butylheptyl(meth)acrylate, octyl(meth)acrylate, 3-isopropylheptyl(meth)acrylate, nonyl(meth)acrylate, decyl(meth)acrylate; (meth)acrylates which derive from unsaturated alcohols, for example 2-propynyl (meth)acrylate, allyl(meth)acrylate, vinyl(meth)acrylate, oleyl(meth) acrylate; cycloalkyl(meth)acrylates such as cyclpentyl (meth)acrylate, and 3-vinylcyclohexyl(meth)acrylate.

Preferred alkyl(meth)acrylates include 1 to 8, more preferably 1 to 4 carbon atoms in the alcohol group. The alcohol group here may be linear or branched.

Examples of vinyl esters having 1 to 11 carbon atoms in the acyl group include vinyl formate, vinyl acetate, vinyl propionate, vinyl butyrate. Preferred vinyl esters include 2 to 9, more preferably 2 to 5 carbon atoms in the acyl group. The acyl group may be linear or branched.

Examples of vinyl ethers having 1 to 10 carbon atoms in the alcohol group include vinyl methyl ether, vinyl ethyl ether, vinyl propyl ether, vinyl butyl ether. Preferred vinyl ethers include 1 to 8, more preferably 1 to 4 carbon atoms in the alcohol group. The alcohol group may be linear or branched.

The term "(di)ester" as used herein means that monoesters, diesters and mixtures of esters, especially of fumaric acid and/or of maleic acid may be used. The (di) alkyl fumurates having 1 to 10 carbon atoms in the alcohol group include monomethyl fumurate, dimethyl fumurate, monoethyl fumurate, diethyl fumurate, methyl ethyl fumurate, monobutyl fumurate, dibutyl fumurate, dipentyl fumurate and dihexyl fumurate. Preferred (di)alkyl fumurates comprise 1 to 8, more preferably 1 to 4, carbon atoms in the alcohol group. The alcohol group may be linear or branched.

The di(alkyl) maleates having 1 to 10 carbon atoms in the alcohol group include monomethyl maleate, dimethyl maleate, monoethyl maleate, diethyl maleate, methyl ethyl maleate, monobutyl maleate, dibutyl maleate. Preferred (di) alkyl maleates comprise 1 to 8, more preferably 1 to 4 carbon atoms in the alcohol group. The alcohol group herein may be linear or branched.

In addition to the repeat units detailed above, the comb polymers used herein may comprise further repeat units which are derived from further comonomers, their proportion being at most 20% by weight, preferably at most 10% by weight and more preferably at most 5% by weight, based on the weight of the repeat units.

These also include repeat units which are derived from alkyl(meth)acrylates having 11 to 30 carbon atoms in the alcohol group, especially undecyl(meth)acrylate, 5-methylundecyl(meth)acrylate, dodecyl(meth)acrylate, 2-methyldodecyl(meth)acrylate, tridecyl(meth)acrylate, 5-methyltridecyl(meth)acrylate, tetradecyl(meth)acrylate, pentadecyl (meth)acrylate, hexadecyl(meth)acrylate, 2-methylhexadecyl(meth)acrylate, heptadecyl(meth)acrylate, 5-isopropylheptadecyl(meth)acrylate, 4-tert-butyloctadecyl(meth)acrylate, 5-ethyloctadecyl(meth)acrylate, 3-isopropyloctadecyl(meth)acrylate, octadecyl(meth)acrylate, nonadecyl(meth)acrylate, eicosyl(meth)acrylate, cetyleicosyl(meth)acrylate, stearyleicosyl(meth)acrylate, docosyl (meth)acrylate and/or eicosyltetratriacontyl(meth)acrylate.

These also include repeat units which are derived from dispersing oxygen- and nitrogen-functionalized monomers such as those listed in paragraphs [0036]-[0059] of US2010/0190671.

The comb polymers which can be used in the compositions herein preferably have a molar degree of branching in the range of from 0.1 to 10 mol %, more preferably from 0.3 to 6 mol %, even more preferably from 0.3 to 1.1 mol %, especially from 0.4 to 1.0 mol % and most preferably from 0.4 to 0.6 mol %.

The molar degree of branching of the comb polymers $f_{branch}$ is calculated by the formula:

$$f_{branch} = \frac{\sum_{a=1}^{A} n_a}{\sum_{a=1}^{A} n_a + \sum_{b=1}^{B} n_b}$$

where:

A is the number of types of repeat units which are derived from polyolefin-based macromonomers, B is the number of types of repeat units which are derived from low molecular weight monomers selected from the group consisting of styrene monomers having 8 to 17 carbon atoms, alkyl(meth)acrylates having 1 to 10 carbon atoms in the alcohol group, vinyl esters having 1 to 11 carbon atoms in the acyl group, vinyl ethers having 1 to 10 carbon atoms in the alcohol group, (di)alkyl fumurates having 1 to 10 carbon atoms in the alcohol group, (di)alkyl maleates having 1 to 10 carbon atoms in the alcohol group, and mixtures of these monomers, $n_a$ is the number of repeat units which are derived from polyolefin-based macromonomers of the type a in the comb polymer molecule.

$n_b$ is the number of repeat units which are derived from low molecular weight monomers selected from the group consisting of styrene monomers having 8 to 17 carbon atoms, alkyl(meth)acrylates having 1 to 10 carbon atoms in the alcohol group, vinyl esters having 1 to 11 carbon atoms in the acyl group, vinyl ethers having 1 to 10 carbon atoms in the alcohol group, (di)alkyl fumurates having 1 to 10 carbon atoms in the alcohol group, (di)alkyl maleates having 1 to 10 carbon atoms in the alcohol group, and mixtures of these monomers, of type b in the comb polymer molecule.

The molar degree of branching arises generally from the ratio of the monomers used if the comb polymer has been prepared by copolymerization of low molecular weight and macromolecular monomers. For the calculation, it is possible here to use the number-average molecular weight of the macromonomer.

If the comb polymer has been obtained by polymer-analogous reaction or by grant copolymerization, the molar degree of branching is found by known methods of determining the conversion.

The proportion of at least 80% by weight, preferably at least 90% by weight, of low molecular weight repeat units which are derived from monomers selected from the group consisting of styrene monomers having 8 to 17 carbon atoms, alkyl (meth)acrylates having 1 to 10 carbon atoms in the alcohol group, vinyl esters having 1 to 11 carbon atoms in the acyl group, vinyl ethers having 1 to 10 carbon atoms in the alcohol group, (di)alkyl fumurates having 1 to 10 carbon atoms in the alcohol group, (di)alkyl maleates having 1 to 10 carbon atoms in the alcohol group, and mixtures of these monomers, and of repeat units which are derived from polyolefin-based macromonomers, is based on the weight of the repeat units. In addition to the repeat units, polymers generally also comprise start groups and end groups which can form through initiation reactions and termination reactions. In one aspect of the present invention, the statement of at least 80% by weight, preferably at least 90% by weight, of low molecular weight repeat units which are derived from monomers selected from the group consisting of styrene monomers having 8 to 17 carbon atoms, alkyl (meth) acrylates having 1 to 10 carbon atoms in the alcohol group, vinyl esters having 1 to 11 carbon atoms in the acyl group, vinyl ethers having 1 to 10 carbon atoms in the alcohol group, (di)alkyl fumurates having 1 to 10 carbon atoms in the alcohol group, (di)alkyl maleates having 1 to 10 carbon atoms in the alcohol group, and mixtures of these monomers, and of repeat units which are derived from polyolefin-based macromonomers, is based on the weight of the comb polymers.

A preferred comb polymer for use herein preferably has 8 to 30% by weight, more preferably 10 to 26% by weight, of repeat units which are derived from polyolefin-based macromonomers, based on the total weight of the repeat units.

Preferred comb polymers for use herein include those which have a weight average molecular weight Mw in the range of 500,000 to 1,000,000 g/mol, more preferably 100,000 to 500,000 g/mol and most preferably 150,000 to 450,000 g/mol.

The number-average molecular weight Mn, may preferably be in the range of 20,000 to 800,000 g/mol, more preferably 40,000 to 200,000 g/mol and most preferably 50,000 to 150,000 g/mol.

Preferably the comb polymers used herein have a polydipersity index Mw/Mn in the range of 1 to 5, more preferably in the range of from 2.5 to 4.5. The number average and the weight average molecular weight can be determined by known processes such as Gas Permeation Chromatography (GPC).

In a particular aspect of the present invention, the comb polymer has a low proportion of olefinic double bonds. The iodine number is preferably less than or equal to 0.2 g per g of comb polymer, more preferably less than or equal to 0.1 g per g of comb polymer. This proportion can be determined according to DIN 53241 after drawing off carrier oil and low molecular weight residual monomers at 180° C. under reduced pressure for 24 hours.

In a preferred embodiment herein the comb polymer has repeat units which are derived from n-butyl methacrylate and/or from n-butyl acrylate. Preferably, the proportion of repeat units which are derived from n-butyl methacrylate and/or from n-butyl acrylate is at least 50% by weight, more preferably at least 60% by weight, based on the total weight of repeat units.

In a preferred embodiment herein the comb polymer has repeat units which are derived from styrene. The proportion of repeat units which are derived from styrene are preferably in the range of 0.1 to 30% by weight, more preferably 5 to 25% by weight.

In a preferred embodiment herein, the comb polymers have repeat units which are derived from alkyl(meth)acrylate having 11-30 carbon atoms in the alkyl radical, preferably in an amount in the range of 0.1% to 15% by weight, more preferably in the range of 1 to 10% by weight.

In a preferred embodiment herein the comb polymer has repeat units which are derived from styrene and repeat units which are derived from n-butyl methacrylate. The weight ratio of styrene repeat units and n-butylmethacrylate repeat units is preferably in the range of 1:1 to 1:9, more preferably 1:2 to 1:8.

In another preferred embodiment, the comb polymer has repeat units which are derived from methyl methacrylate and repeat units which are derived from n-butyl methacrylate, preferably in a weight ratio of 1:1 to 0:100, more preferably 3:7 to 0:100.

A commercially available comb polymer suitable for use herein is available from Evonik under the tradename Viscoplex 3-201.

Preferably, the composition contains at least 0.1 wt. % of a pour point depressant. As an example, alkylated naphthalene and phenolic polymers, polymethacrylates, maleate/fumarate copolymer esters may be conveniently used as effective pour point depressants. Preferably not more than 0.3 wt. % of the pour point depressant is used.

Furthermore, compounds such as alkenyl succinic acid or ester moieties thereof, benzotriazole-based compounds and thiodiazole-based compounds may be conveniently used in the lubricating composition herein as corrosion inhibitors.

Compounds such as polysiloxanes, dimethyl polycyclohexane and polyacrylates may be conveniently used in the lubricating composition herein as defoaming agents.

Compounds which may be conveniently used in the lubricating composition herein as seal fix or seal compatibility agents include, for example, commercially available aromatic esters.

The above-mentioned additives are typically present in an amount in the range of from 0.01 to 35.0 wt. %, based on the total weight of the lubricating composition, preferably in an amount in the range of from 0.05 to 25.0 wt. %, more preferably from 1.0 to 20.0 wt. %, based on the total weight of the lubricating composition.

Preferably, the composition contains at least 9.0 wt. %, preferably at least 10.0 wt. %, more preferably at least 11.0 wt % of an additive package, for example, comprising an anti-wear additive, a metal detergent, an ashless dispersant and an anti-oxidant.

The lubricating compositions herein are preferably engines oils for use in the crankcase of an engine. The engine oil may include a heavy duty diesel engine oil, a passenger car motor engine oil, as well as other types of engine oils, such as motor cycle oils and marine engine oils.

The lubricating compositions herein may be so-called "low SAPS" (SAPS=sulphated ash, phosphorus and sulphur), "mid SAPS" or "regular SAPS" formulations.

For Passenger Car Motor Oil (PCMO) engine oils the above ranges mean:

a sulphated ash content (according to ASTM D 874) of up to 0.5 wt. %, up to 0.8 wt. % and up to 1.5 wt. %, respectively;

a phosphorus content (according to ASTM D 5185) of up to 0.05 wt. %, up to 0.08 wt. % and typically up to 0.1 wt. %, respectively; and a sulphur content (according to ASTM D 5185) of up to 0.2 wt. %, up to 0.3 wt. % and typically up to 0.5 wt. %, respectively.

For Heavy Duty Diesel Engine Oils the above ranges mean:

a sulphated ash content (according to ASTM D 874) of up to 1 wt. %, up to 1 wt. % and up to 2 wt. %, respectively;

a phosphorus content (according to ASTM D 5185) of up to 0.08 wt. % (low SAPS) and up to 0.12 wt. % (mid SAPS), respectively; and a sulphur content (according to ASTM D 5185) of up to 0.3 wt. % (low SAPS) and up to 0.4 wt. % (mid SAPS), respectively.

The lubricating compositions of the present invention may be conveniently prepared using conventional formulation techniques by admixing base oil with the metal-free phosphonate anti-wear additive and other additive components/additive package at a temperature of, for example, around 60° C.

The present invention is described below with reference to the following Examples, which are not intended to limit the scope of the present invention in any way.

EXAMPLES

Example 1 and Comparative Example 1

Two lubricating compositions were formulated (Comparative Example 1 and Example 1). Comparative Example 1 was a Heavy Duty Diesel Engine Oil having the formulation shown in Table 1. Said formulations were manufactured by blending together the various components using conventional mixing techniques.

Example 1 is the same as Comparative Example 1 but 0.95 wt % of the ZDTP (by weight of the lubricant composition of Comparative Example 1) is replaced with 0.76 wt % of diamyl amyl phosphonate (DAAP) (by weight of the lubricant composition). DAAP is commercially available from Sigma-Aldrich. In Example 1, the difference in wt % between the ZDTP and the DAAP (0.19 wt %) is made up by GTL4 base oil.

TABLE 1

| | Wt % |
|---|---|
| GTL4[1] | 62 |
| GTL8[2] | 19.77 |
| Oloa 4413[3] | 0.5 |
| Pour Point Depressant | 2.5 |
| Infineum SV 151[4] | 0.5 |
| Additive Package[5] | 14.73 |

[1]GTL4 is a Fischer-Tropsch derived base oil having a kinematic viscosity at 100° C. (ASTM D445) of approximately 4 cst ($mm^2/s$). This GTL4 base oil may be conveniently manufactured by the process described in e.g. WO02/070631, the teaching of which is hereby incorporated herein the reference.

[2]GTL8 is a Fischer-Tropsch derived base oil having a kinematic viscosity at 100° C. (ASTM D445) of approximately 8 cst ($mm^2/s$). This GTL8 base oil may be conveniently manufactured by the process described in e.g. WO02/070631, the teaching of which is hereby incorporated herein the reference.

[3]Anti-rust additive commercially available from Chevron-Oronite.

[4]VI Improver commercially available from Infineum.

[5]HDDEO Additive package comprising salicylate detergent, high molecular weight dispersant, ZDTP, Aminic anti-oxidant and phenolic antioxidant.

1. GTL 4 is a Fischer-Tropsch derived base oil having a kinematic viscosity at 100° C. (ASTM D445) of approximately 4 cst ($mm^2/s$). This GTL 4 base oil may be conveniently manufactured by the process described in e.g. WO02/070631, the teaching of which is hereby incorporated herein by reference.
2. GTL8 is a Fischer-Tropsch derived base oil having a kinematic viscosity at 100° C. (ASTM D445) of approximately 8 cst ($mm^2/s$). This GTL 8 base oil may be conveniently manufactured by the process described in e.g. WO02/070631, the teaching of which is hereby incorporated herein by reference.
3. Anti-rust additive commercially available from Chevron-Oronite.
4. VI Improver commercially available from Infineum.
5. HDDEO Additive package comprising salicylate detergent, high molecular weight dispersant, ZDTP, Aminic anti-oxidant and phenolic antioxidant.

Wear, Friction and Oxidative Stability Tests

Comparative Example 1 and Example 1 were subjected to the various friction, wear and oxidative stability tests described below.

MTM Friction Test

Friction measurements were carried out on a Mini Traction Machine (MTM; PCS Instruments) in a sliding-rolling ball-on-disc setup. The MTM simulates the lubrication regime found in non-conformal components such as cams and followers, gears and rolling element bearings. The test contact is formed between a polished ¾ inch ball and a highly polished 46 mm diameter disc, both made of AISI 52100 steel (hardness 750-770 HV), each driven independently to produce a sliding/rolling contact. The root-mean-square roughness of ball and disc is 11±3 nm, with a composite surface roughness of 16 nm. To perform a test, a small sample of fluid is placed in the test reservoir and the system steps through a series of load, speed, slide/roll ratio and temperature steps. The friction generated between the ball and plate contact is measured by means of a torque transducer mounted on the ball shaft. New specimens (balls and discs) were used for each test and were cleaned with a trisolvent mixture of iso-propanol, heptane, and acetone in an ultrasonic bath for 10 minutes prior to testing. The temperature was kept constant (115° C.) throughout the test. The applied load was 30 N, equivalent to a mean Hertz pressure of 0.94 GPa. The slide-roll ratio (SRR), defined as the ratio of the sliding speed (μb-μd) to the entrainment speed (μb+μd)/2 (where μb and μd are the speed of the ball and the disc, with respect to the contact) was 50%. The test conditions used in this test were as follows:

| | |
|---|---|
| Ball speeds | 100 mm/s |
| Normal force | 30 N |
| Calculated contact pressure | 935 MPa |
| SRR | 50% |
| Temperature | 115° C. |
| Total contact time | 120 mins |

SRV Wear Test

Wear analysis was performed on an Optimol SRV-4 instrument in cylinder on disk mode with a load of 200N, 3 mm stroke length at 130° C. The hardened steel cylinder was 11×15 mm (diameter×length). A sample pan holder was made to fit the steel disks (6.9×22 mm). The sample pan held approximately 2 ml of oil. The disk specimens were either steel or DLC-coated steel; the cylinder was always a steel surface. The two test specimens (e.g. cylinder and disk) were installed in the test chamber and pressed together with a specified normal force. The top specimen oscillates on the bottom specimen. Frequency, stroke, test load, test temperature and test duration are pre-set; friction force is continually measured. The friction coefficient is automatically calculated and recorded during the entire test duration. Wear is measured and recorded either during and/or after the test.

The oils were blended with 4.76% carbon black as a soot surrogate to increase severity in the test. The test conditions used in this test were as follows:

| | |
|---|---|
| Normal force | 200 N |
| Stroke | 3.0 mm |
| Frequency | 20 Hz |
| Temperature | 130° C. |
| Test duration | 180 min |
| Pmax initial | 192 MPa |

PDSC Oxidation Test

Oxidation induction time was measured in a pressure differential scanning calorimeter (pDSC) using the CEC-L-85-99 test method, an industry standard test.

The test conditions used in this test were as follows:

| | |
|---|---|
| Pan type | TA hermetic, aluminium |
| Sample weight | 2.0 mg ± 0.05 mg |
| Air atmosphere | 100 (±7) psig, 690 (48) kPa g |
| Flow rate | Static, no flow |
| Sample | |
| Loading Temperature | <40° C. |
| Equilibration Temperature | 50° C. (±2) |
| Equilibration Time (at 50° C.) | 5 min |
| Temperature Ramp Rate | 40 (±10)° C./min |
| Isothermal Test | |
| Temperature V | 210° C. (±0.5) |
| Test Duration | 120 mins maximum at isothermal test temperature |

Slide-Roll Rig Test

Additional wear analysis was performed using a wear component test based on actual components (crosshead) and slide-roll conditions adapted from the Cummins M11 engine. Wear was measured on the crosshead using an optical profilometer. The conditions used in this test were as follows:

| | |
|---|---|
| Normal force | 600 N |
| Stroke | 6.2 mm |
| Frequency | 20 Hz |
| Temperature | 115° C. |
| Test duration | 15 hours |

In this test, the lubricating oils were blended with 4.76% carbon black as a soot surrogate.

The friction, wear and oxidative stability measurements for Comparative Example 1 and Example 1 are shown in Table 2 below.

TABLE 2

| | Friction coefficient | Wear Volume ($\mu m^3$) (SRV Wear Test) | Oxidation Induction Time (min) | Wear Volume ($mm^3$) (Slide-Roll Rig Test) |
|---|---|---|---|---|
| Comparative Example 1 | 0.1145 | 49518 | 103.23 | 0.238 |
| Example 1 | 0.0595 | 14821 | 110.49 | 0.133 |

Discussion

Table 2 shows that the replacement of 0.95 wt % of ZDTP in Comparative Example 1 with 0.76 wt % of DAAP leads to a reduction both in friction coefficient and wear volume even in the presence of carbon black as a soot surrogate.

In addition, the oxidative stability of Example 1 is comparable to that of Comparative Example 1.

That which is claimed is:

1. A lubricating composition comprising:

(i) base oil;

(ii) diamyl amyl phosphonate (DAAP) as a metal-free phosphonate compound; and (iii) a viscosity index improver, wherein the viscosity index improver is a comb polymer having a molar degree of branching from 0.1 to 10 mol %, and wherein the lubricating composition is free of metal-containing thiophosphate compounds and wherein the lubricating composition comprises 0.08% wt % or less of phosphorus, by weight of the lubricating composition.

2. A lubricating composition comprising:

(i) base oil;

(ii) diamyl amyl phosphonate (DAAP) as a metal free phosphonate compound; and (iii) a viscosity index improver, wherein the viscosity index improver is a comb polymer having a molar degree of branching from 0.1 to 10 mol %, wherein the lubricating composition is free of metal-containing thiophosphate compounds, and wherein the base oil comprises Fischer-Tropsch derived base oil.

3. The lubricating composition according to claim 1 wherein the lubricating composition is a passenger car motor oil.

4. The lubricating composition according to claim 1 wherein the lubricating composition is a heavy-duty diesel engine oil.

5. The lubricating composition according to claim 1 wherein the lubricating composition is a motorcycle engine oil.

6. A method comprising:

applying a lubricating oil composition to a surface in relative movement to another surface in a crankcase of an engine, wherein the lubricating oil composition comprises:

(i) base oil;

(ii) diamyl amyl phosphonate (DAAP) as a metal-free phosphonate compound; and (iii) a viscosity index improver, wherein the viscosity index improver is a comb polymer having a molar degree of branching from 0.1 to 10 mol %, and wherein the lubricating composition is free of metal-containing thiophosphate compounds and wherein the lubricating composition comprises 0.08 wt % or less of phosphorus, by weight of the lubricating composition.

7. The lubricating composition according to claim 2 wherein the lubricating composition is a passenger car motor oil.

8. The lubricating composition according to claim 2 wherein the lubricating composition is a heavy-duty diesel engine oil.

9. The lubricating composition according to claim 2 wherein the lubricating composition is a motorcycle engine oil.

* * * * *